United States Patent [19]

Kimball

[11] Patent Number: 4,753,161

[45] Date of Patent: Jun. 28, 1988

[54] APPARATUS AND METHOD FOR MULTICOLOR SILK SCREEN PRINTING OF CAPS

[76] Inventor: George L. Kimball, Box 1152, Windham, Me. 04062

[21] Appl. No.: 55,988

[22] Filed: Sep. 30, 1987

[51] Int. Cl.[4] ..... B41F 17/00

[52] U.S. Cl. ..... 101/35; 101/115; 101/126; 101/129

[58] Field of Search ..... 101/126, 129, 115, 35; 223/7, 23, 24

[56] References Cited

U.S. PATENT DOCUMENTS 4,438,693 3/1984 Serrianne et al. ..... 101/129

*Primary Examiner*—Clifford D. Crowder

[57] ABSTRACT

In order to hold the frontal area of visored headgear against a platen of approximately the size and shape of the area during the printing thereon of data in two or more colors, at least one first member and a second member are employed. The members are movable relative to the platen between inoperative and operative positions. In the operative position of the first member or members, portions of headgear are held under one end of the platen after the central portion of the sweat band has been caught by the other platen end and headgear material manually pulled under said one end to pull the frontal area against the platen. In the operative position of the second member, it seats the area to be printed against the platen and holds said area against moving vertically during successive screen contacts.

25 Claims, 7 Drawing Sheets

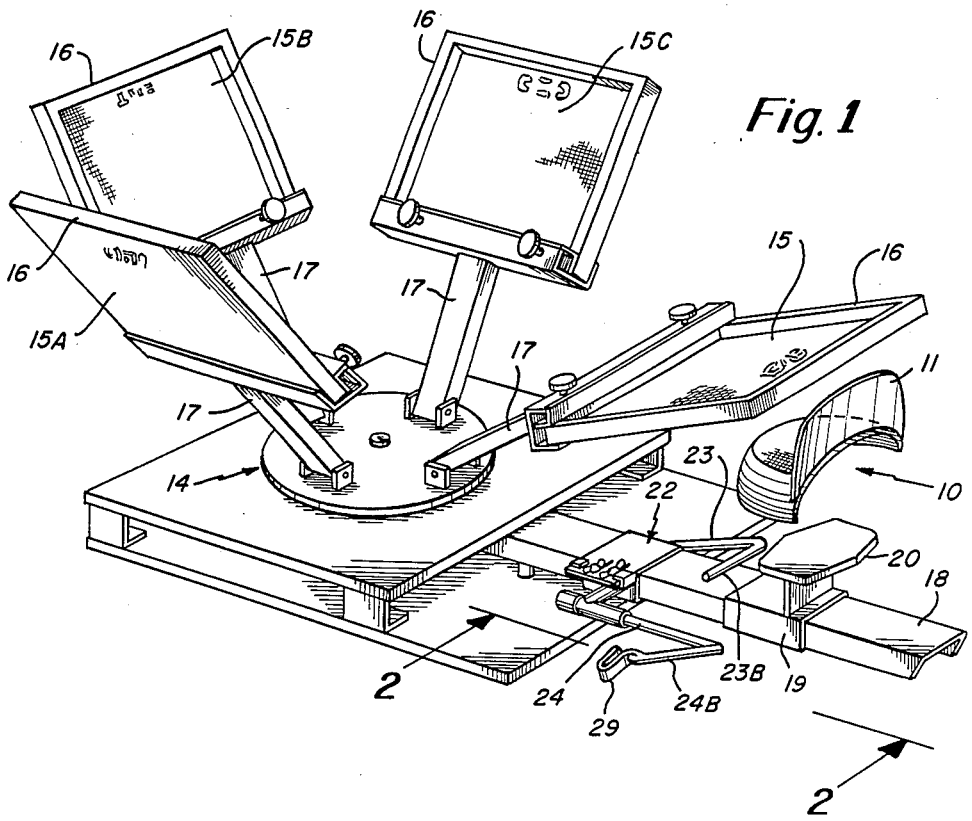
Fig. 1
Fig. 2
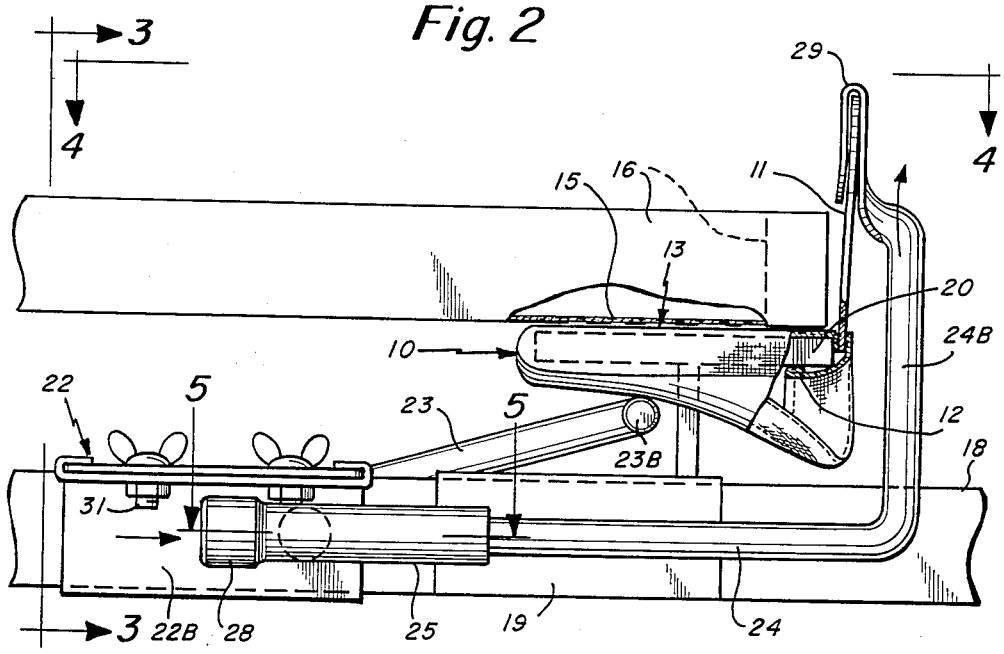

29
11
10
20
13
23B
24B
22
31
19
26
23
23A
22A
22B
24A 20
23
21
12
11
13
11
18
22
22A
30
19
23B
29
24B
22B
28
25
24

29A
11A
20A
10A
36
20B
39
36A
38
32
34
41
33
18A
39
34
41

33
10A
34
11A
20B
29A
36
37A
39
18A
38
34
32
40A
40
41
35

APPARATUS AND METHOD FOR MULTICOLOR SILK SCREEN PRINTING OF CAPS

BACKGROUND OF THE INVENTION

A substantial market exists for visored caps of the type having a central, frontal area directly above its visors on which data is printed of which logos, company names and the representation of objects are examples.

Such data is applied utilizing a silk screen printer having a fixed rail or arm on which a flat platen is mounted which is substantially the size and shape of the area of the cap on which the data is to be printed. The platen is so supported that it is spaced above the rail with forward and rearward portions so exposed that a cap, when the front central portion of its sweat band is caught by the forward portion and the cap pulled rearwardly downwardly over the rearward portion, the frontal area is drawn into position on the platen.

Silk screen printers have rotatable heads or tables with each table having pivotable arms in radial support of silk screens each of which may be brought into contact with the frontal area of a thus positioned cap when the table is or has been turned to bring a selected screen into a predetermined position relative to the rail and the platen is appropriately positioned thereon to be in the path of that screen so that the ink pattern and color thereof will be applied to the frontal area of the cap.

When only a single color is to be applied, no problem exists but when two or more colors are required, the printing the caps of an order is customarily attended by an objectionably high percentage of rejects.

When multi-color printing is involved, it is the combination of the patterns of the different screens that establishes the wanted data. Unless the different patterns register in a precise relationship, the printed data is defective since color overlaps or gaps are readily apparent. The problem is that previously a slight movement of the frontal portion of a cap occurs when a screen is brought into contact therewith and while the existence of such movements has been recognized, all attempts to avoid them of which I am aware have failed to prevent them.

THE PRESENT INVENTION

The general objective of the present invention is to enable visored head gear having a visor to be so secured to a platen that such movements of the area to be printed are prevented that would cause the features of data consisting of two or more colors to fail to register.

This objective is attained by providing silk screen printing equipment with a flat platen having forward and rearward portions exposed to enable the sweat band of the head gear to be caught under the forward portion and cap material to be pulled rearwardly and disposed under the rearward portion in a manner drawing the frontal portion of the head gear, which portion is to be provided with the printed data, against the platen. Holding means, consisting of at least one first member, is provided which is movable between an inoperative position permitting such disposition of the cap material and a operative position in which the material disposed under the rearward portion of the platen is anchored. If the visor is now held in a position normal to the platen, the portion of the head gear to be printed is flattened against the platen. Where the printed platen is to be in a plurality of colors, the equipment includes, to insure accurate registration of successively applied data, a second member operable not only to hold the visor in such a normal position but also to prevent vertical movements of the visor.

In accordance with one embodiment of the invention, this objective is attained by employing first and second members attachable to the rail of a silk screen printer with each having inoperative and operative positions with reference to the platen and to head gear when positioned thereon as previously described. Both members, when in their inoperative positions, enable a cap to be fitted on the platen or removed therefrom. In the operative position of the first member, it is under the rearward position of the platen and presses and holds the folded-under portion of the head gear securely against the undersurface thereof. In the operative position of the second member, it engages and holds the visor in a fixed position substantially normal to the arm. The two members thus cooperate in so holding the frontal area against the platen that the patterns of any and all subsequent contacts of screen therewith accurately register.

In another embodiment of the invention, the equipment includes a holder or slide to which the two members are connected and which is slidably connected to the rail rearwardly of the platen but movable forwardly into an operative position to bring the first member into the above described position, pressing and holding the folded under head gear portions against the undersurface of the platen. The second member includes a visor clip and a clip holding portion and is pivotable relative to the holder to enable the clip holding portion to be swung in a plane normal to the rail with the inoperative position holding the clip laterally thereof. When the holder has been moved forwardly to establish the operative position of the first member the clip is in a plane enabling it to be brought into engagement with the visor holding it in a position substantially normal to the platen.

In another embodident of the invention, the apparatus includes a mount attachable to the printer in a predetermined position relative to the path of the screen or screens to be used in printing the data on the frontal area of the head gear. The mount is provided with the platen and the first member is pivotally connected thereto in a manner enabling it to swing in a horizontal plane into and out of an operative position in which portions of head gear folded under the rear edge of the platen are clamped against movement.

When the head gear consists of a visor and a frontal area to be printed, the only material which can be folded under the platen is the head band and for holding such material against the undersurface of the material, the mount is provided with two arms, one pivotally connected thereto at each side and each is shaped and disposed to swing between inoperative positions and an operative position under the platen in which the folded under portions of the band are held in place.

In order that the same mount may be used for both types of head gear and to enable the connection between the first member and the mount to be used for one of the two arms, the first member and the two arms are removable.

For either type of head gear, when multi-color data is to be printed, the mount is provided with a second member pivotally connected thereto to swing between an inoperative position and an operative position in which the visors are held substantially perpendicular to the platen and against moving vertically when thus held as then the area to be printed is depressed against the platen. In the case of the printing of data in one color, the second member is unnecessary as a suitable position of the area to be printed can, for examples, be established as by manually holding the visor or by a holder connected to the screen.

Other objectives of the invention and the manner of their attainment will be apparent from the following description of the preferred embodiment of the invention and the appended claims.

BRIEF DESCRIPTION OF THE DRAWINGS

The accompanying drawings illustrate a preferred embodiment of the invention of which FIG. 1 is a perspective view of the screen carrying turntable or head of a silk screen printer equippped with an attachment in accordance with the present invention;

FIG. 2 is a section, on an increase in scale, taken approximately along the indicated lines 2—2 of FIG. 1 but with a cap held in position and a selected one of the screens in printing contact therewith;

THE PREFERRED EMBODIMENT OF THE INVENTION

Figure 3:
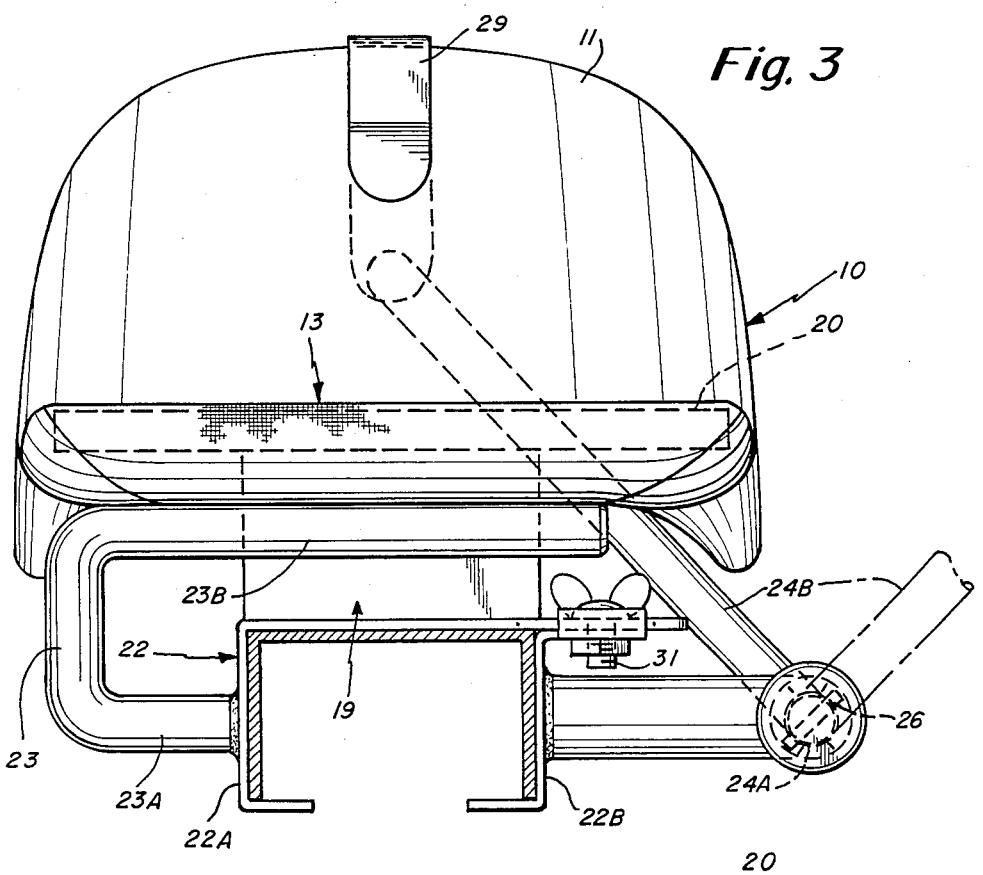
FIG. 3 is a section on a further increase in scale, taken along the indicated line 3—3 of FIG. 2.
Figure 4:
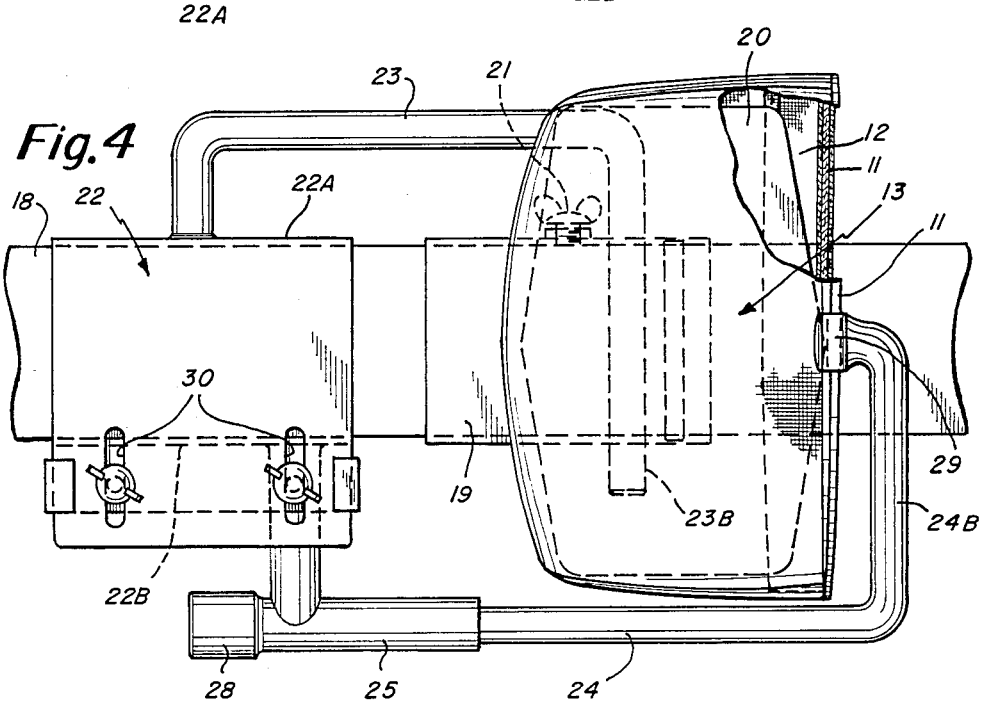
FIG. 4 is a view taken along the indicated line 4—4 of FIG. 2.

A typical hat of the type with which the present invention is concerned is generally indicated at 10 and has a visor 11 and a sweat band 12. A frontal, central area 13, directly above the visor 11 is commonly printed with data which may be of a single color but which are more often multi-colored. Such caps when delivered to the printer have their rear half portions 10A folded under against their front half portions 10B.

A silk screen printer for use in printing data on such caps is not detailed and is shown and described only to the extent that its general features and operation may be appreciated. Such a printer, see FIG. 1, has a rotatable head or turntable 14 having a circumferentially spaced series of framed screens 15, 15A, 15B, and 15C each held by a frame 16 with the frames supported by arms 17 each of which is pivotally connected to the turntable 14 so as to enable each screen to be moved vertically from its raised, inoperative position downwardly into an operative printing position.

The printer also has a radial arm or rail 18 below the turntable on which is mounted a slide 19 spacing a flat platen 20 above the rail 18 in a manner exposing its forward and rearward portions. The platen 20 is positioned relative to the rail 18 to be in printing position of a screen when the turntable 14 has been appropriately turned and that screen brought downwardly into its printing position and it will be noted that such printers have means, not shown, releasably preventing the turning of the turntable when a screen is thus positioned. It will also be noted that the slide 19 is releasably locked to the rail as by a set screw 21 once it is positioned in the path of the data of the screens In accordance with the invention, the rail 18 is provided with a jig or holder, rearwardly of the platen 20 and consisting of a mount 22 slidably supported by the rail and first and second members, generally indicated at 23 and 24, respectively.

In practice, a cap 10 is placed on the platen 20 with its sweat band 12 caught under the forward portion of the platen 20 and the cap then manually pulled rearwardly and downwardly and disposed under and forwardly of the rearward portion of the platen in a manner to bring the cap area 13 against the platen 20 which is substantially of the same size and shape as that area. The visor 11 is then positioned substantially a right angles to the plane of the platen.

The function of the first member 23 is to hold the thus disposed and manually held portions of cap material against movement and the function of the second member 24 is to hold the visor in said substantially normal position and against vertical movements and the two members cooperate when in their operative position to hold securely the thus positioned cap throughout the printing operation.

To that end, the first member 23 is an arm parallel to the side of the mount to which one end 23A is fixed in a manner holding the arm so forwardly and upwardly inclined that its transversely disposed end 23B will, as the mount 22 is moved forwardly, pass under the rearward portion of the platen 20 to press the cap material against the undersurface thereof so that it need not be manually held. The resulting pressure causes the mount 22 to become so bound to the rail 18 that it does not accidentally move rearwardly making the use of a set screw unnecessary.

Figure 5:
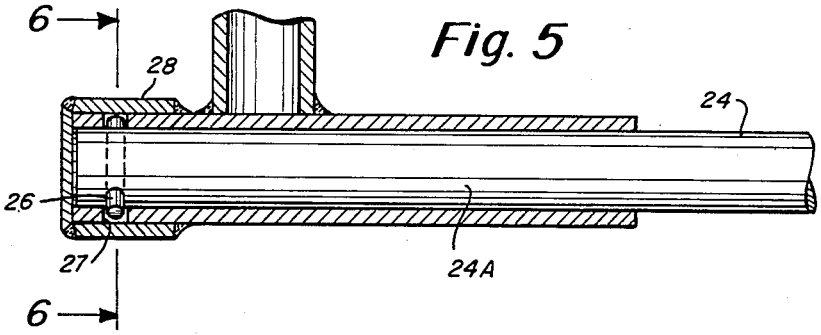
FIG. 5 is a section, on an increase in scale, taken along the indicated line 5—5 of FIG. 2.
Figure 6:
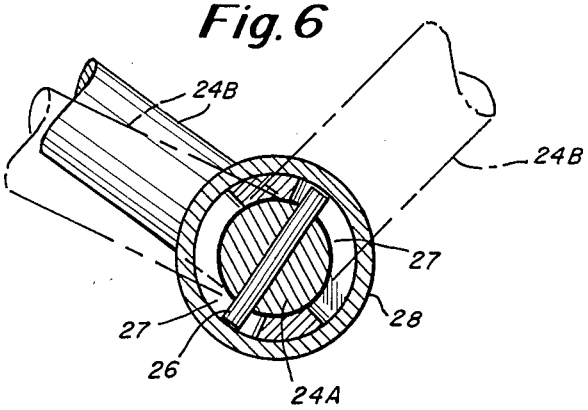
FIG. 6 is a section taken along the indicated line 6—6 of FIG. 5.

The second member 24 has its rear end 24A rotatable in a socket 25 secured in an offset but parallel relationship to the other side of the mount 22 and, see FIGS. 5 and 6, held captive therein by means of a pin 26 extending diametrically therethrough and through diametrically opposed transverse slots 27 in the socket 25 which are of a length to permit the member 24 to turn therein to a predetermined extent. The slots 27 ar covered by an end cap 28.

The second member 24 has a forward end 24B disposed at right angles thereto and is provided with a U-shaped visor clip 29 at its free end. The member 24 is so dimensioned that when the mount 22 is moved forwardly into its operative position, the forward end 24B is in the plane of the visor 11 if positioned normal to the platen 20. It will be appreciated that prior to the forward movemcnt of the mount 22, the member 24 is or has been turned to position the forward end 24B well to one side of the rail 18 as shown in FIG. 1 thus to permit a cap 10 to be fitted to or removed from the platen 20 and the forward end 24B is of sufficient length so that in the forward, operative position of the mount 22, the path of the clip 29 as the second member 24 is turned into its operative position will engage and hold the visor if in said normal position then to hold it against movement.

With the cap 10 fitted and secured to the platen 20, a screen is then brought downwardly into printing contact with the area 13, that screen raised, the turntable 14 turned appropriately and another screen brought downwardly into its operative position until the printing of the multi-color data is complete.

It should be noted that with the visor 11 thus held the seating of the area 13 against the platen is assured but in order not to restrict the size of the area, the ends of the screen frame 16 are not more than of one-half an inch in thickness to ensure against the forward end of the frame engaging the visor 11 or making it necessary to increase the spacing of the printed data therefor.

In order that the slide 22 may be fitted to rails of different widths, it is shown as having parts 22A and 22B each fitted atainst the appropriate one of the sides of the rail 18 and the bottom thereof. The parts 22A and 22B have overlying ends at on side of the rail 18 which have parallel registering slots 30 through which bolts 31 extend enabling the width of the slide 27 to be varied as required The embodiment of the invention illustrated by FIGS. 7–14 is adapted for use, in either of two ways, in the silk screen printing of data in one or more colors on the frontal portion of visored headgear when seated against a platen.

In this embodiment of the invention, a mount 32 is shown as slidable on the arm or rail 18A of a silk screen printer and locked thereto in a desired position as by means of a set screw 33. While the platen 20A may be a separate component of the apparatus, it is preferred and as shown that it be attached to the front portion of the mount 32 as by a transverse wall 20B.

The mount is shown as provided with upwardly opening sockets 34, one at each side and close to the rear end thereof and a horizontal socket 35 shown as attached to the mount at one side of its front end.

In one use of this embodiment, one generally similar to that described in connection with the embodiment illustrated by FIGS. 1–6, a first member 36 has one end 36A disposed at a right angle thereto for entry into a selected one of the sockets 34 and has its other end shaped to establish a head, generally indicated at 37 and having curved ends and a central straight portion 37A which, when the first member is seated in the selected socket 34, lies in a plane parallel to the platen 20A. The end 36A is provided with a stop pin 38 engageable with the upper end of the socket to establish that plane close to but below the platen so that the first member may swing in that plane from its inoperative position shown in FIG. 7 forwardly into its operative position under the platen then to jam portions of the cap 10A securely against the undersurface of the platen 20A and its supporting wall 20B when the cap 10A is positioned thereon in the manner described in connection with the silk screen printing of the cap 10.

Figure 7:
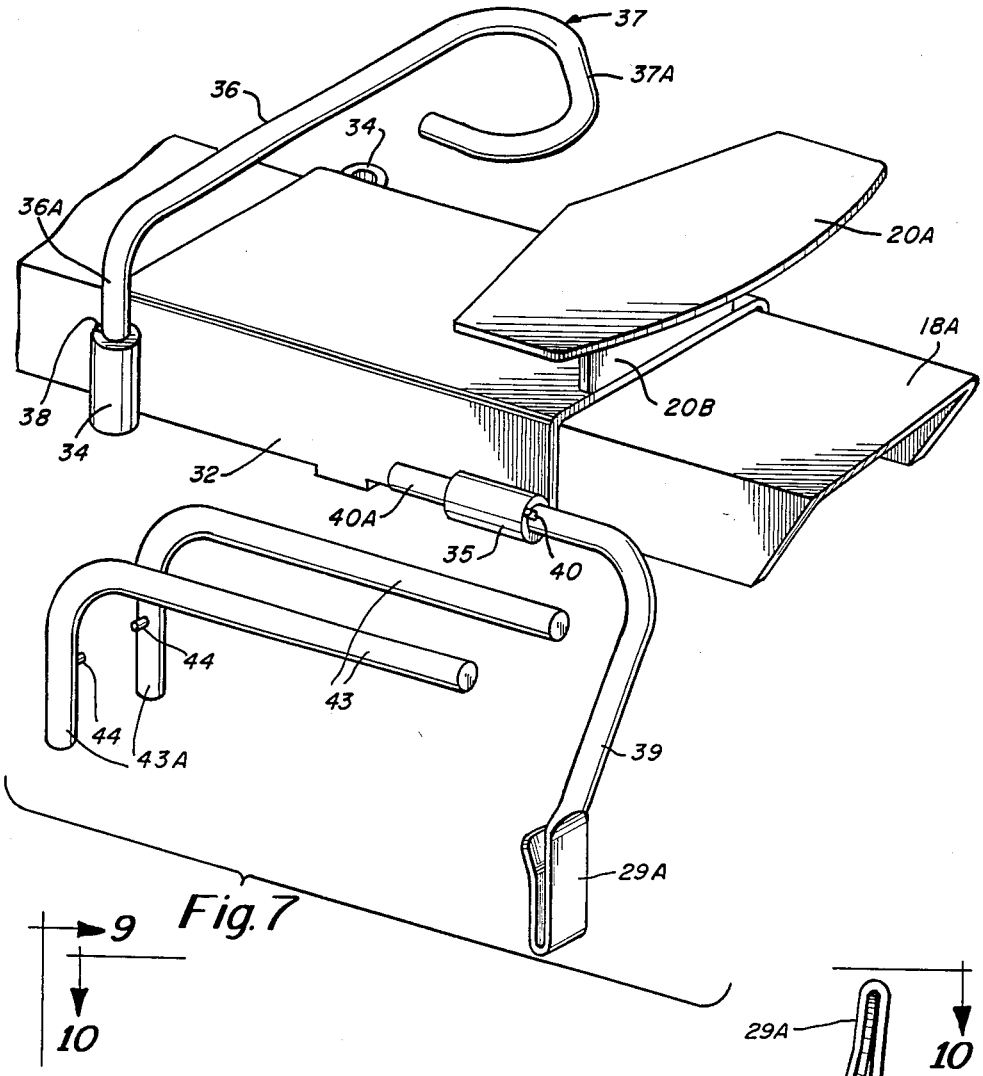
FIG. 7 is a perspective view of another embodiment of the invention.
Figure 8:
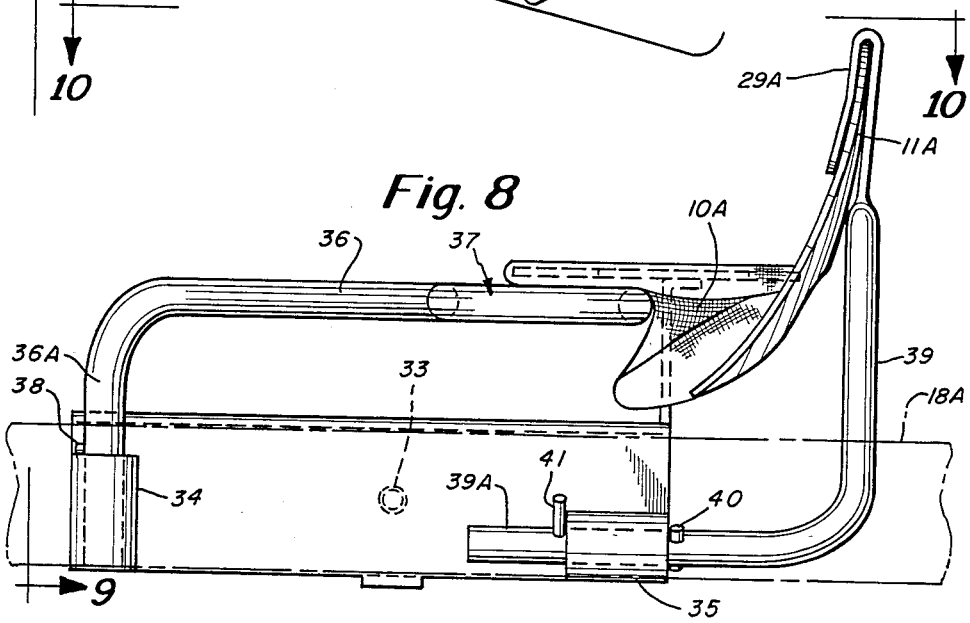
FIG. 8 is a fragmentary side view of the attachment illustrated by FIG. 7.
Figure 9:
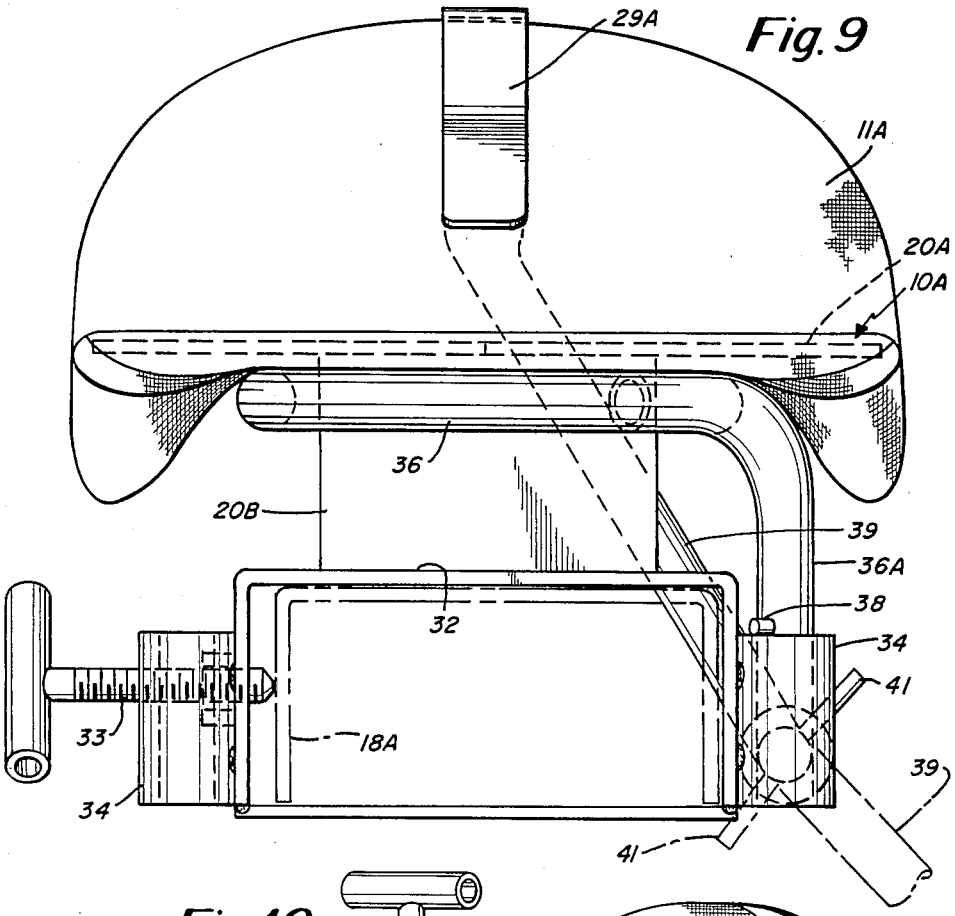
FIG. 9 is a view taken approximately along the indicated line 9—9 of FIG. 8.
Figure 10:
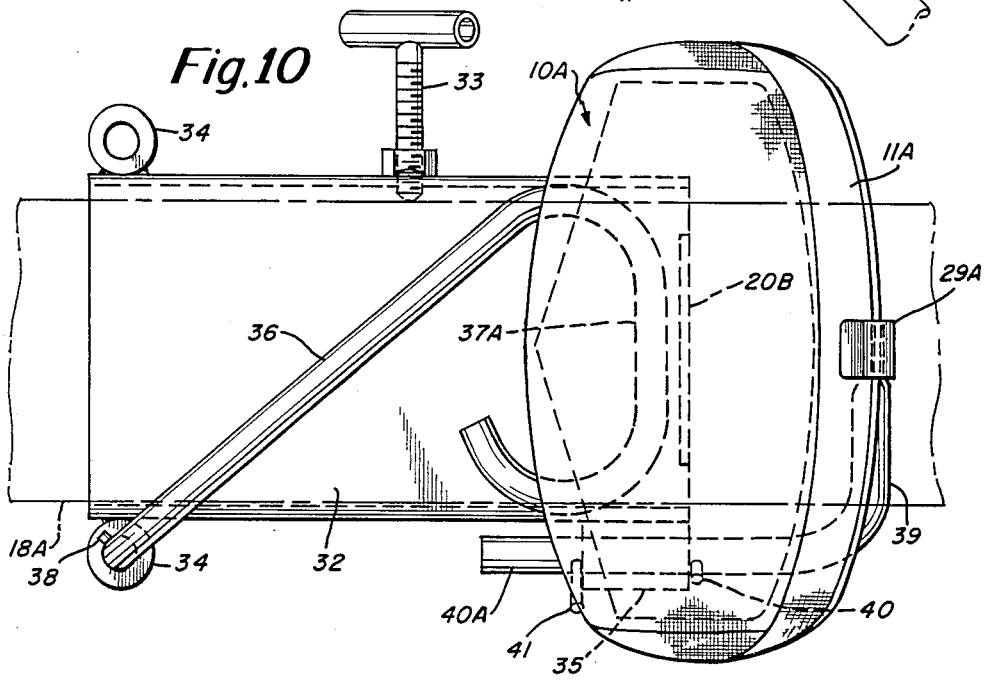
FIG. 10 is a view of the attachment taken approximately along the indicated line 10—10 of FIG. 8.
Figure 11:
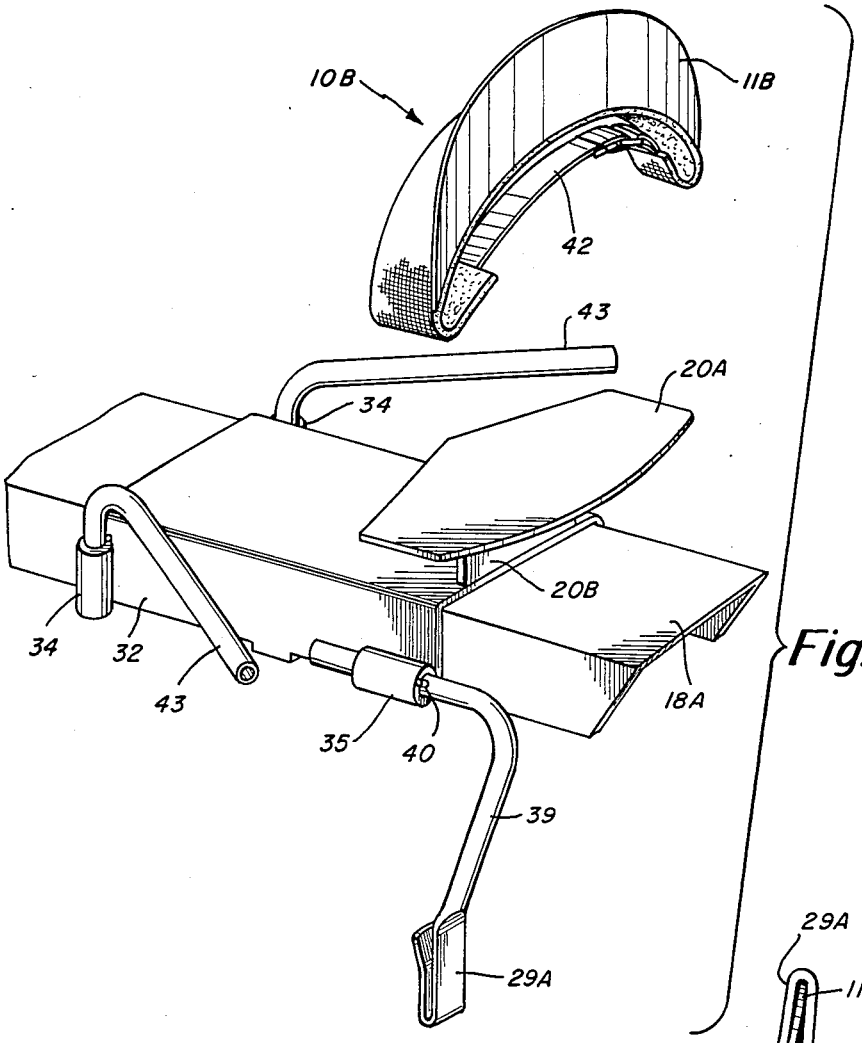
FIG. 11 is a perspective view of the attachment as it is used in the silk screen printing of head gear of the type having only head band material t be disposed under the rearward portion of the platen.
Figure 12:
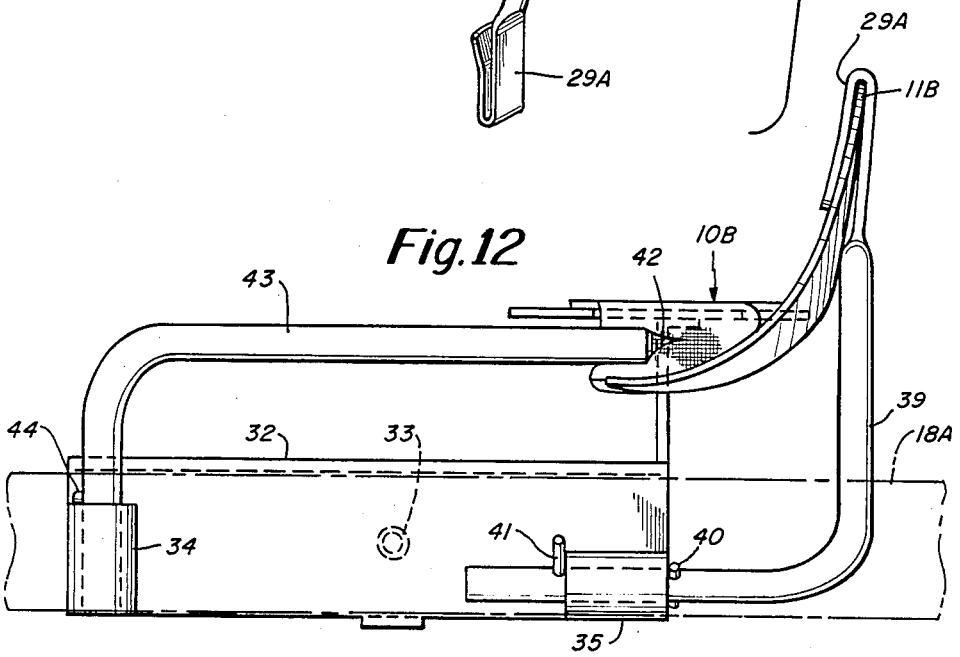
FIG. 12 is a fragmentary side view of the attachment of FIG. 11.
Figure 13:
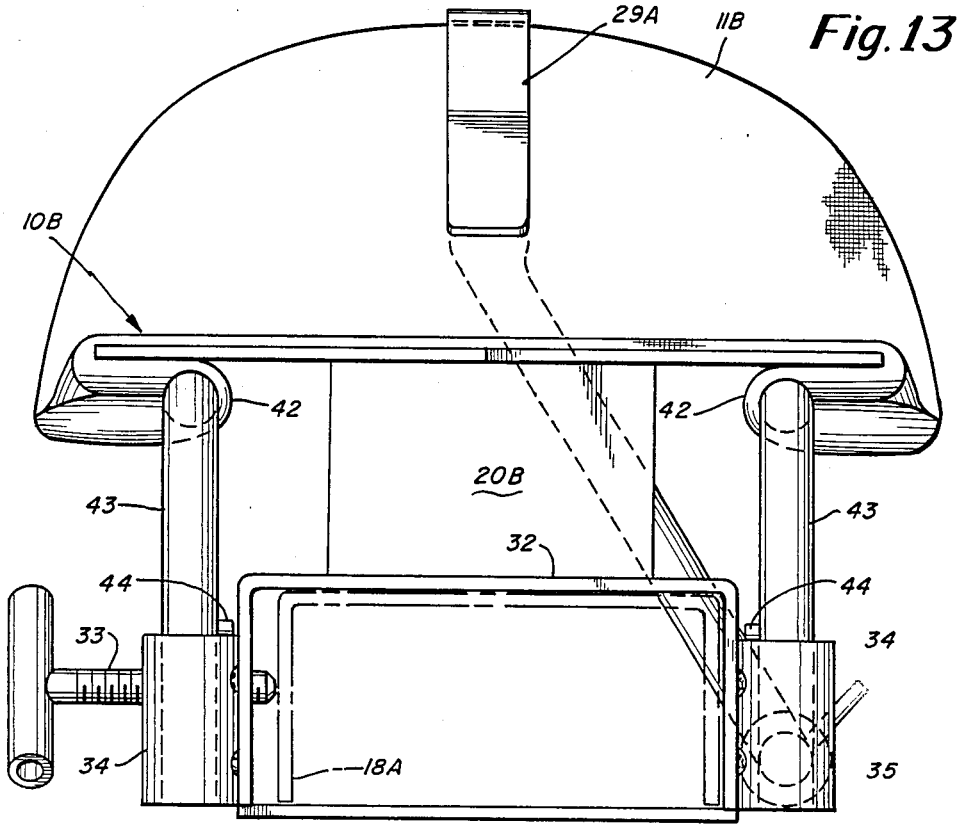
FIG. 13 is a view of the attachment of FIG. 11 as viewed from the rear end thereof.
Figure 14:
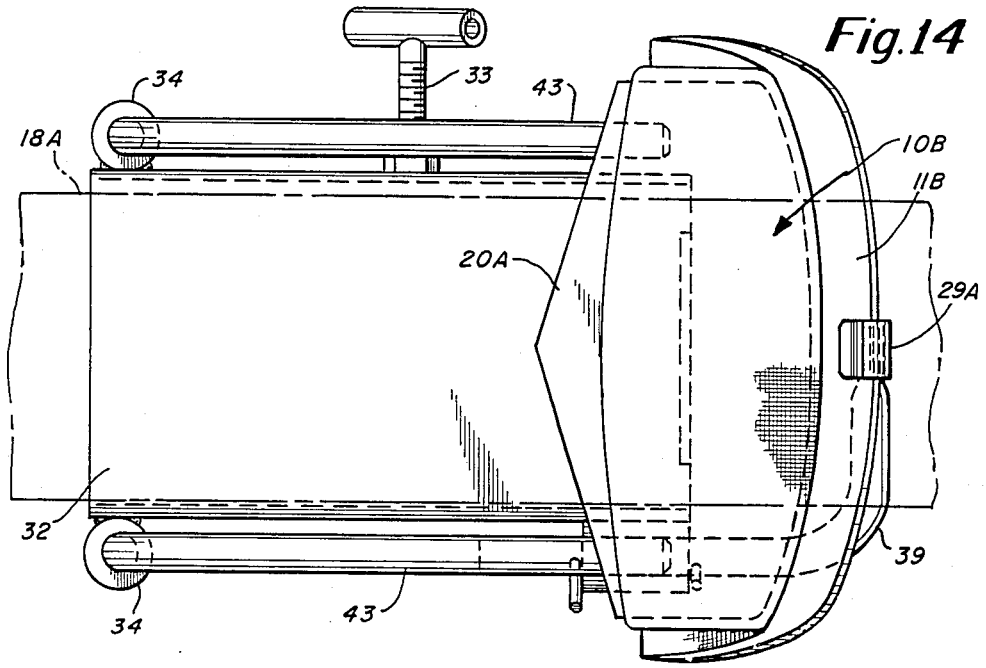
FIG. 14 is a top plan view of the attachment.

A visor holding member 39 has a end portion 39A shown as held captive in the socket 35 by front and rear pins 40 and 41, respectively, and disposed at an angle such that the clip 29A on the other end of the member 39, when the member 39 is swung from its inoperative position at one side of the mount, see FIG. 7, into its vertical position, is engageable with the visor 11A. The clip 29A then holds the visor against movement from a position in which the frontal portion to be printed is depressed and held flat against the platen 20A while one or more silk screens are brought into printing contact therewith.

The second use of the mount 32 is for the silk screen printing of any visored headgear such as the caps 10 and 10A and also such headgear where substantially the only part thereof that is to be clamped under the platen 20A is the head band 43.

For this use the first member 36 is replaced by two first members 43 which can be and typically are identical. Each first member 43 has an end 43A disposed at a right angle thereto and dimensioned for entry into the appropriate one of the sockets 34. In practice, each first member 43 is provided with a stop pin 44 so located that the thus connected first members can swing forwardly from their inoperative positions in the same plane close to but below the platen 20A so that they may pass under it from opposite sides and jam material of any of the above identified headgear pulled over the side or rear edges of the platen against the undersurface of the platen and in so doing pull the frontal portion to be printed against the undersurface of the platen.

I claim:

1. Apparatus for use in the silk screen printing of data in one or more colors on a central frontal area of a visored headgear having a sweat band, said apparatus including a silk screen for each color and having a part of the data thereon which is in that color, a flat platen of approximately the size and shape of said area, a support on which said platen is mounted with forward and rearward portions exposed in order that a visored headgear may have the front of its sweat band caught under the forward portion and then pulled manually downwardly and held under said rearward portion in a manner drawing said area against the platen, at least one first member connected to the support and movable relative thereto between an inoperative position in which a cap may be thus positioned on the platen or removed therefrom and an operative position in which said first member holds the portions of the cap under said rearward portion against moving, said apparatus also including a second member movable into and out of an operative position in which a portion thereof is operable to engage, seat hold the visor flat against vertical movements, and means operable to place said screens successively in printing contact with said area, said members cooperating in preventing movements of said frontal area that would then prevent registration of the data of said screens when applied thereto.

2. The apparatus of claim 1 and a mount to which the first and second members are connected and which is connected to the support for movement along a straight path between first and second positions in the first of which the members are in their inoperative positions and in the second of which the first member is in its operative position and the second member has advanced therewith into a second position, said second member movable transversely of said path and in the second position thereof movable into the operative position thereof.

3. The apparatus of claim 1 in which the second member is connected to themount to have an axis of rotation parallel to the path along which the mount is movable and includes an end portion disposed at right angles to said axis and of sufficient length to engage and hold the visor against vertical movements.

4. The apparatus of claim 3 in which there is a clip at the free end of said end portion receptive of the brim of the visor.

5. The apparatus of claim 1 in which the second member is connected to the support in a manner enabling the second member to swing into and out of the operative position thereof in a plane inclusive of the visor if normal to the plane of the platen.

6. The apparatus of claim 1 and a mount connected to the support and means connecting the first and second members to the mount in a manner such that the first member can swing between the operative and inoperative positions thereof in a horizontal plane and that the second member can swing between the operative and the inoperative positions thereof.

7. The apparatus of claim 6 in which there are two first members which are pivotally connected to opposite portions of the mount to swing between the operative and inoperative positions thereof in a horizontal plane, said first members dimensioned to swing under opposite sides of the rearward platen portion.

8. Apparatus for use with a silk screen printer in printing data in one or more colors on a frontal area of a visored headgear having a sweat band, said printer of a type having a rail on which a flat platen is mounted in a manner spacing it therefrom and with the forward and rearward portions exposed said headgear having the front, central portion of its sweat band caught by the forward portion of the platen to enable headgear material to be pulled under the rearward portion thereof in a manner operable to pull the frontal area downwardly, said printer also having a screen for each color and provided with a portion of the data in that color, said screens successively positionable in a predetermined position relative to and spaced-from said arm and then movable into a predetermined printing position, said platen in said position, said apparatus including at least one first member and a second member, said members attached to said rail and movable between operative and inoperative positions, the first member when in its operative position in engagement with the headgear material under the rearward portion and pressing and holding those portions against movement, and the second member when in the operative position thereof operable to hold the visor of the cap substantially normal to said platen and against moving vertically and thereby to ensure the holding of the frontal are seated against the platen and held against movement during engagement of the screens therewith.

9. The apparatus of claim 8 and a mount to which the first and second members are connected and which is slidably attached to the rail for movement between first and second positions, in the first of which the first and second members are in their inoperative positions and in the second of which the first member is in the operative position thereof and the second member has advanced therewith into a second position, said second member movable in a plane normal to the rail into the operative position thereof.

10. The apparatus of claim 9 in which the second member is pivotally connected to the mount to have an axis of rotation parallel to the rail and includes an end portion disposed at right angles to said axis and of sufficient length to engage the visor when turned into the operative position of the second member.

11. The apparatus of claim 10 in which the mount has a socket establishing said axis and said second member has an opposite end portion rotatable within said socket and said opposite end portion and said socket include a connection enabling said second member to be turned between first and second limits in the first of which the angularly disposed end portion is spaced laterally of the platen and in the second position of which the operative position of the second member is established.

12. The apparatus of claim 11 in which the free end of the angularly disposed end portion of the second member includes a clip receptive of the visor.

13. The apparatus of claim 9 in which the first member is forwardly and upwardly inclined and includes a transverse end portion positioned in the operative position of the first member to underlie the rearward portion of the platen and jam the portions of the cap under said rearward portion thereagainst.

14. The apparatus of claim 8 and a mount to which the platen is connected and which is attachable to the rail of the printer, and means connecting the first and second members thereto in a manner such that the first member can swing between the operative and inoperative positions thereof in a horizontal plane and that the second member can swing between the operative and inoperative positions thereof.

15. The apparatus of claim 8 in which there are two first members which are pivotally connected to opposite portions of the mount to swing between the operative and inoperative positions thereof in a horizontal plane, said first members positioned and dimensioned to swing under opposite sides of the rearward platen portion.

16. An attachment for a silk screen printer of a type used in printing data in two or more colors on the frontal area of a visored cap having a sweat band, the printer having a rail on which a platen is mounted with first and second end portions exposed, the platen of approximately the size and shape of the frontal area and a plurality of silk screens, one for a portion of the data and in an appropriate one of the colors, each screen movable into contact with the platen when in a predetermined position relative thereto, said attachment including a mount connected to the rail for movement into and out of an operative position proximate to the platen, a first member connected to the mount and inclined upwardly towards the platen to pass under the second end thereof when the mount is in said operative position in a manner such that the first member will be operative to jam and hold thereagainst portions of a cap which has had its sweat band caught by the first end of the platen portion and then manually pulled downwardly over the platen with said portions disposed under said second end of the platen portion in a manner seating the frontal area against the platen and a second member connected to the mount in a manner such that when said first member is in its operative holding position the second member is movable into a position engaging and holding the visor of the cap against vertical movements and substantially normal to the plane of the platen whereby the two members cooperate to hold the frontal area against any movement that would prevent registration of the portions of the data printed thereby during successive screen engagements.

17. The attachment of claim 16 in which the second member is pivotally connected to the mount to have an axis of rotation parallel to the rail and includes an end portion disposed at right angles to said axis and of sufficient length to engage the visor when the second member is turned into the operative position thereof.

18. The attachment of claim 17 in which the mount has a socket offset from one side thereof and the second member has an opposite end portion rotatable within the socket and said opposite end portion and said socket include a connection enabling said second member to be turned between first and second limits in the first of which the angularly disposed end portion is spaced laterally of the platen and in the second position of which the operative position of the second member is established.

19. The attachment of claim 18 in which the free end of the angularly disposed end portion of the second member includes a clip receptive of the visor.

20. The attachment of claim 17 in which the first member is inclined upwardly towards the end portion of the second member and includes a transverse end portion positioned to pass under the second end of the platen into its operative position when the mount is in its operative position.

21. The method of printing data in at least two colors on the frontal area of a visored cap having a sweat band while using a silk screen printer having a screen for each color, and a rail on which a platen is mounted in a spaced relation thereto and with the forward and rearward portions thereof exposed, each screen when in a predetermined position relative to said arm, movable into and out of a predetermined printing position, the platen of approximately the size and shape of said frontal area and in said printing position thus to be engageable by the screens, said method consisting of the steps of catching the front of the sweat band under the forward portion of the platen, forcing the remainder of the cap rearwardly of and under the rearward portion of the platen in a manner to pull the frontal portion downwards, then holding said remainder against movement and also holding the visor substantially normal to the plane of the platen and against vertical movement to hold the frontal portion seated against the platen until each screen has been brought into and out of printing contact with said frontal area.

22. Apparatus for use in the silk screen printing of data in at least one color on a central frontal area of headgear having a visor, a sweat band, and means to attach the headgear to the head of a wearer, a flat platen of approximately the size and shape of said area, a mount on which said platen is supported with forward and rearw rd portions of the platen exposed in order that headgear may have the front of its sweat band caught under the forward portion and then the remainder of the headgear pulled rearwardly over and downwardly and held under said rearward portion in a manner drawing said area against the platen, and at least one member connected to said mount for movement relative to the platen between inoperative and operative positions in a horizontal plane, in said operative position said member holding the portions of the headgear under said rearward portion against moving, and a second member movable between inoperative and operative positions, in said operative position, said second member seating said frontal area against the platen.

23. The apparatus of claim 22 in which the second member is connected to the mount in a manner enabling the second mcmber to swing in a vertical plane between the operative and inoperative positions thereof.

24. The apparatus of claim 23 in which the second member includes a clip operable to hold the visor substantially normal to the plane of the platen and against vertical movement.

25. The apparatus of claim 22 in which there are two first members which are pivotally connected to opposite portions of the mount and are shaped and dimensioned to swing under opposite sides of the rearward portion of the platen.

* * * * *